US008136280B2

(12) United States Patent
Spelman

(10) Patent No.: US 8,136,280 B2
(45) Date of Patent: Mar. 20, 2012

(54) HAND HELD PLACARD DISPLAY WITH A PLURALITY OF INDIVIDUAL MESSAGES MOUNTED IN A CIRCULAR BOUND FASHION

(76) Inventor: Jim Spelman, Fenton, MI (US)

( * ) Notice: Subject to any disclaimer, the term of this patent is extended or adjusted under 35 U.S.C. 154(b) by 17 days.

(21) Appl. No.: 12/691,768

(22) Filed: Jan. 22, 2010

(65) Prior Publication Data

US 2010/0180478 A1 Jul. 22, 2010

Related U.S. Application Data

(63) Continuation-in-part of application No. 09/814,210, filed on Mar. 21, 2001.

(51) Int. Cl.
*G09F 21/02* (2006.01)

(52) U.S. Cl. ..... 40/586; 40/541

(58) Field of Classification Search ..... 40/586, 40/541; 340/815.45, 908, 231
See application file for complete search history.

(56) References Cited

U.S. PATENT DOCUMENTS

| | | | | |
|---|---|---|---|---|
| 841,706 | A | 1/1907 | Morden | |
| 1,778,766 | A * | 10/1930 | McMichael | 462/83 |
| 2,898,878 | A * | 8/1959 | Reinholdt | 116/28 R |
| 2,915,849 | A | 12/1959 | Johnston | |
| 3,237,330 | A | 3/1966 | Dinstibir | |
| 3,800,430 | A | 4/1974 | Samra | |
| D263,972 | S | 4/1982 | Pasker | |
| 4,431,984 | A | 2/1984 | Bileck | |
| 4,574,269 | A | 3/1986 | Miller | |
| 4,886,390 | A | 12/1989 | Silence et al. | |
| 4,949,071 | A | 8/1990 | Hutchison | |
| 4,982,683 | A | 1/1991 | Earnest, Jr. | |
| 5,053,746 | A | 10/1991 | Taneo | |
| D327,229 | S | 6/1992 | Bonneville | |
| D331,472 | S | 12/1992 | Campbell | |
| D331,981 | S | 12/1992 | Fischel et al. | |
| D336,662 | S | 6/1993 | Smith et al. | |
| 5,276,424 | A * | 1/1994 | Hegemann | 340/321 |
| 5,301,982 | A * | 4/1994 | Brotz | 283/83 |
| D375,978 | S | 11/1996 | Fitzgerald | |
| 5,574,428 | A | 11/1996 | Groover | |
| 5,599,048 | A * | 2/1997 | Schioler | 283/92 |
| 5,892,461 | A | 4/1999 | Dokko | |
| 5,905,434 | A | 5/1999 | Steffan et al. | |
| 5,905,441 | A | 5/1999 | Klee et al. | |
| 5,973,607 | A | 10/1999 | Munyon | |
| 6,198,410 | B1 * | 3/2001 | White et al. | 340/907 |
| 7,343,704 | B1 * | 3/2008 | Wilson | 40/547 |

FOREIGN PATENT DOCUMENTS

AU 8425136 A 9/1984

* cited by examiner

*Primary Examiner* — Casandra Davis
(74) *Attorney, Agent, or Firm* — Gifford, Krass, Sprinkle, Anderson & Citkowski, P.C.

(57) ABSTRACT

A hand-held inter-auto display device includes a handle portion and an interconnecting and substantially planar display portion. A plurality of individual sheets, each displaying at least a portion of a selected message, are displayed from at least one side of the planar display portion. A visual enhancement element, including any of LED elements, phosphorescent coatings or reflective lettering, is associated with at least one of the handle, display portion and sheets to better display a selected message of an exposed sheet supported upon the display portion.

12 Claims, 6 Drawing Sheets

FIG. 7A
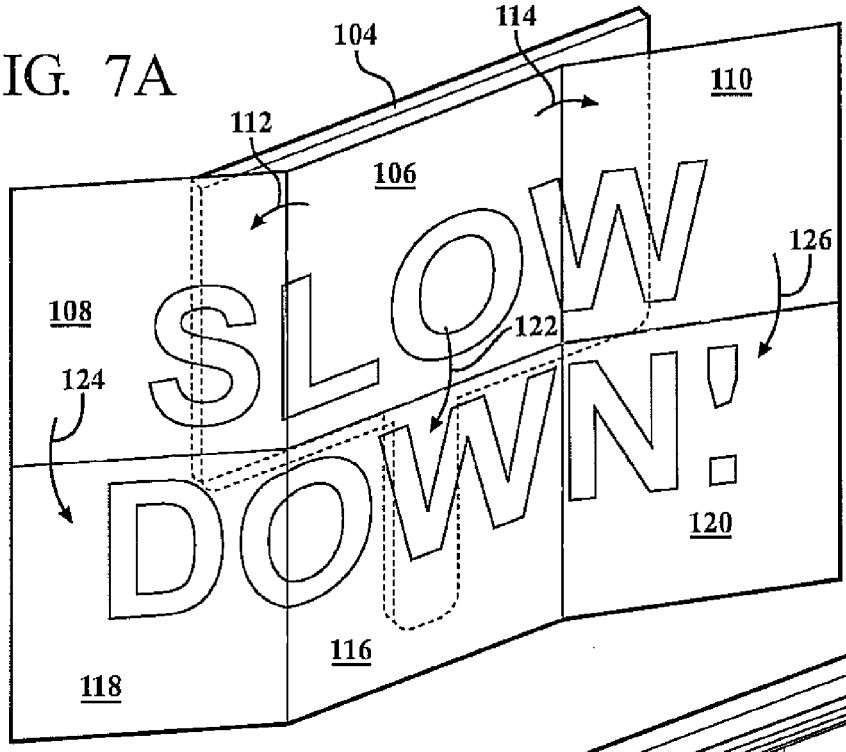
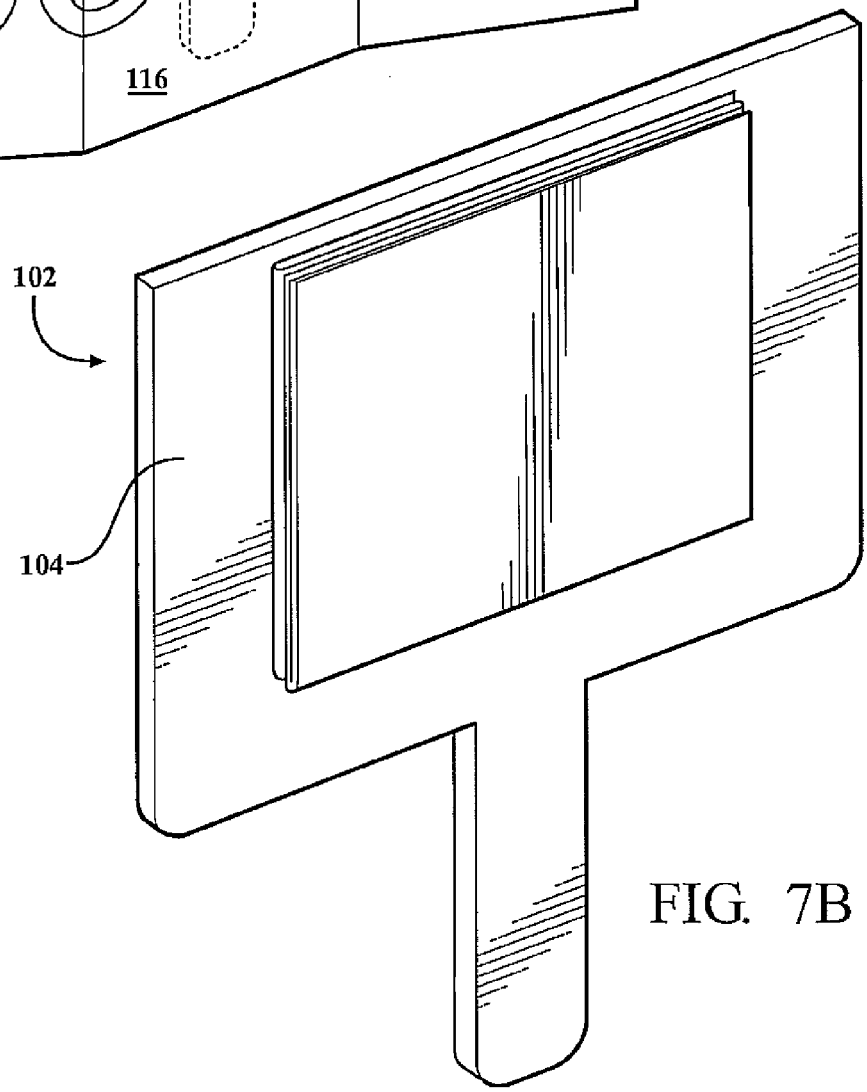
FIG. 7B

HAND HELD PLACARD DISPLAY WITH A PLURALITY OF INDIVIDUAL MESSAGES MOUNTED IN A CIRCULAR BOUND FASHION

CROSS-REFERENCE TO RELATED APPLICATIONS

This Application is a Continuation-in-part of application Ser. No. 09/814,210 filed on Mar. 21, 2001 and entitled Hand-Held Placard Display Incorporating a Plurality of Individual Messages Mounted in a Circular Binding Fashion.

FIELD OF THE INVENTION

The present invention relates generally to inter-automotive or vehicle related communication devices and, more particularly, to a hand-held display device incorporating a number of individual, and preferably spiral bound, messages of sufficient size and dimension and which are mounted to a suitable display support for flashing by an operator or passenger of a vehicle to a driver or occupant of one or more other vehicles.

BACKGROUND OF THE INVENTION

The prior art is well documented with various types of inter-vehicle display devices for communicating messages from the operator of one vehicle to the operators of one or more other vehicles. A professed advantage of such devices is to provide a degree of inter-vehicle communication in instances in which it would assist vehicle safety.

One known example of a communication board for vehicles is set forth in Australian Patent Abstract AU-A-25136/84 and which teaches a hand-held panel to which a plurality of spiral bound message sheets are attached. The communication board is held against the rear, front or side windows dependent upon the location of the vehicle to which the message is directed.

U.S. Pat. No. 3,237,330, issued to Dinstibir, teaches a dashboard mounted warning device for vehicles, and including such as a central/inner display member to which are secured outer ply sheets with various messages. The stacked arrangement is supported atop a suction cup attachment.

U.S. Pat. No. 841,706, issued to Morden, teaches a book ring with spring hinged joints. U.S. Pat. No. 2,915,849, issued to Johnston, further discloses a music holder exhibiting a rigid and substantially rectangular supporting member gripped at one edge by a spring clamping mechanism carried by a band instrument.

SUMMARY OF THE INVENTION

The present invention is a hand-held signal display device for use by a driver or occupant of a vehicle and in order to communicate desired messages to the drivers or occupants of other vehicles and during specific driving situations. The present invention is admittedly a "low-tech" approach to accomplishing inter-vehicle communication, however one that has been demonstrated to be very effective in accomplishing the desired communication, with the advantage that it decreases the instances of driver frustration, road rage and overall better attitudes of drivers when on the road.

The hand held display device of the present invention includes a support with a handle portion and an interconnecting and substantially planar display portion. The display portion has a first surface and a second oppositely facing surface defining therebetween a specified thickness.

A plurality of individual and stackable sheets of material are provided, each of the sheets displaying a selected message on at least one side thereof, each of the messages being presented according to a selected content, coloring and lettering style. In a preferred variant, each of the sheets of material is constructed of a semi-rigid poster board material. In the further preferred variant, the display portion and messages supported thereon are of a sufficient size and dimension so that the content of the messages are easily visible to surrounding motorists. In a preferred construction, a six, inch height and a twelve inch width have found to be most effective in both the ease of manipulation of the device by the user within the vehicle, as well as being visible to occupants in the vehicle or vehicles being signaled.

The sheets are pivotally bound to the planar display portion of the support so that a selected message, displayed on a first selected sheet located upon the first surface, may be rotated to abut against the second oppositely facing surface and to reveal an underlying and second selected sheet located upon the first surface and displaying a further selected message. The pivotally binding further is provided with at least one binding ring engaging through the display portion, between the first and second facing surfaces, and proximate an extending edge opposite the handle portion.

In one variant, a pair of first and second binding rings are located at specified and spaced apart distances, each of the rings being separately attachable and disengageable from the display portion by first pivotally associated and arcuately configured portions and second pivotally associated and arcuately configured portions, a clasp extending from an end of each of the first configured portion and receivingly engaging within an aperture defined proximate an end of the second associated configured portion. In a further variant, a plurality of spiral binding portions engage through the display portion, between the first and second facing surfaces, and proximate an extending edge opposite the handle portion. An additional feature of the invention also contemplates a display mount at a specified location within the vehicle and within which may be seatingly engaged the handle portion and so that the message arrayed upon the display portion is visible to occupants of other vehicles.

Additional variants include the incorporation of additional illuminating or lighting aspects, these including such as the provision of LED elements to the extending surface perimeter of the supporting display portion. In this variant a power supply (such as a Lithium ion or other type watch battery) can be incorporated into an accessible handle compartment Another variant contemplates a forming the display portion and/or handle with a phosphorescent (glowing) composition to assist in easy identification. The individual message sheets can also exhibit luminescent or light reflective lettering to assist in ease of remote identification. The individual lettering of the sheets can also exhibit color (or multi-color) to further assist in identification.

A yet further variant contemplates a fold-out panel configuration, and by which a series of overlapping and selected edge connected sheets can be mounted to the display portion, or to a rigid support sheet which is in turn spiral bound to the display portion. The fold out/fold down sheets each further exhibit semi-rigid consistency and in order to establish an enlarged display area.

BRIEF DESCRIPTION OF THE DRAWINGS

Reference will now be made to the attached drawings, when read in combination with the following detailed description, wherein like reference numerals refer to like parts throughout the several views, and in which:

FIG. 7A is an illustration of a fold-out panel configuration, and by which a series of overlapping and selected edge connected sheets each further exhibit a semi-rigid consistency and are unfolded in order to establish an enlarged display area;

FIG. 7B is an illustration of a fold-out message panel configuration according to a further preferred embodiment.

DETAILED DESCRIPTION OF THE PREFERRED EMBODIMENTS

Figure 1:
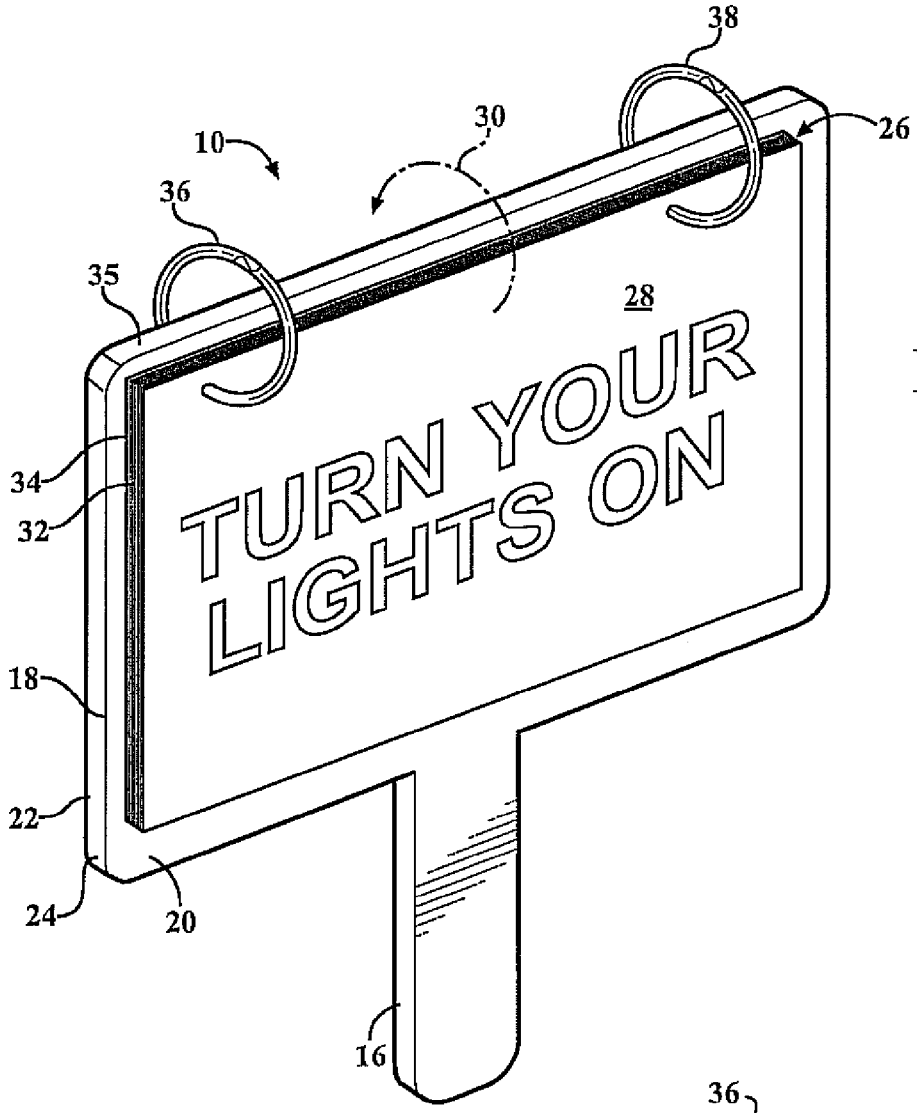
FIG. 1 is a perspective view of the hand-held and inter-auto display device according to a first preferred variant of the present invention.
Figure 3:
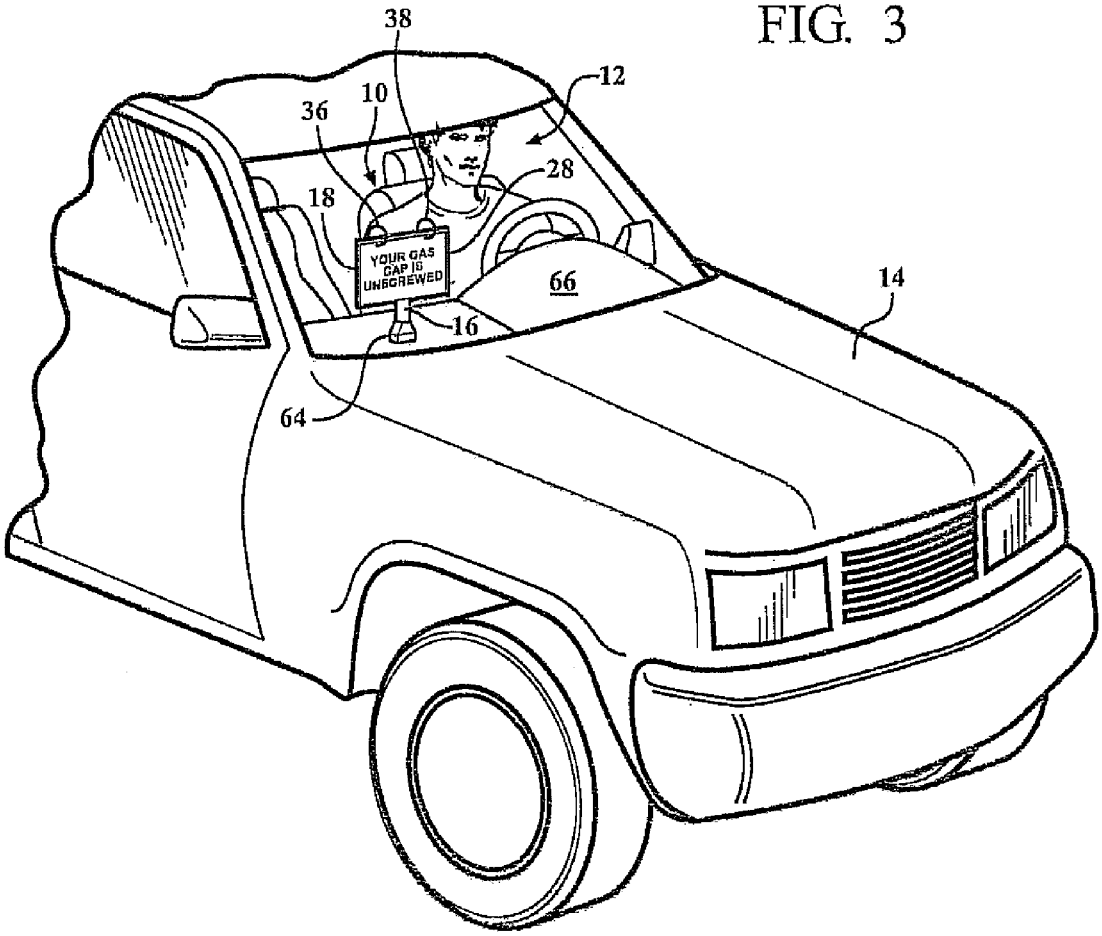
FIG. 3 is an environmental view and illustrating the display device mounted within a suitable vehicle location.

Referring now to FIG. 1, a hand-held signal display device is illustrated at 10 according to a first preferred embodiment of the present invention. Referring farther to the environmental view of FIG. 3 (and which illustrates one specific application of the present invention), the signal display device 10 is for use by a driver 12 or other occupant of a vehicle 14 and in order to communicate desired messages to the drivers or occupants of other vehicles (not shown) during specific driving situations. As again was previously described, the present invention is admittedly a "low-tech" approach to accomplishing inter-vehicle communication, however one that has been demonstrated to be very effective in accomplishing the desired communication, with the advantage that it decreases the instances of driver frustration, road rage and overall better attitudes of drivers when on the road.

With reference again to FIG. 1, the hand held display device 10 includes a support with a handle portion 16 and an interconnecting and substantially planar display portion 18. In the preferred variant, the handle and display portions of the support are constructed of an integrally formed material (typically molded or casted) and such as a polymer or plasticized resin. The display portion 18 further includes first surface 20 and a second oppositely facing surface 22 defining therebetween a specified thickness 24.

A plurality of individual and stackable sheets of material 26 are provided. Each of the sheets displays a selected message on at least one side thereof and which is according to a selected content, coloring and lettering style. Such a selected message is illustrated at 28 (according to one desired material content) and which is succeeded by any plurality of additional messages sequentially stacked beneath the selected message 28.

In a preferred variant, each of the sheets of material 26 are constructed of a semi-rigid poster board material. As previously explained, it is important that the display portion 18 and messages 26 supported thereon are of a sufficient size and dimension so that the content of the messages (such as again is illustrated by selected message 28) is easily visible to surrounding motorists. Therefore, and in a preferred construction, a six inch height and a twelve inch width have found to be most effective in both the ease of manipulation of the device by the user 12 within the vehicle 14, as well as being visible to occupants in the vehicle or vehicles (again not shown) being signaled.

Referring again to FIG. 1, the sheets are pivotally bound to the planar display portion of the support so that the selected message (such as again at 28), displayed on a first selected sheet located upon the first surface, may be rotated to abut against the second oppositely facing surface 22 and to reveal an underlying and second selected sheet located upon the first surface and displaying a further selected message. The direction of the pivotal rotation is indicated by arrow 30 in FIG. 1 and the underlying messages are illustrated at 32, 34, et.seq. in FIG. 1 in succeeding fashion beneath the initial message 28.

The pivotal binding of the display device requires at least one binding ring engaging through the display portion 18, between the first 20 and second 22 oppositely facing surfaces, and proximate an extending edge 35 located opposite the handle portion 16. As illustrated in the preferred variant 10 of FIG. 1, a pair of first 36 and second 38 binding rings are located at specified and spaced apart distances.

Figure 4:
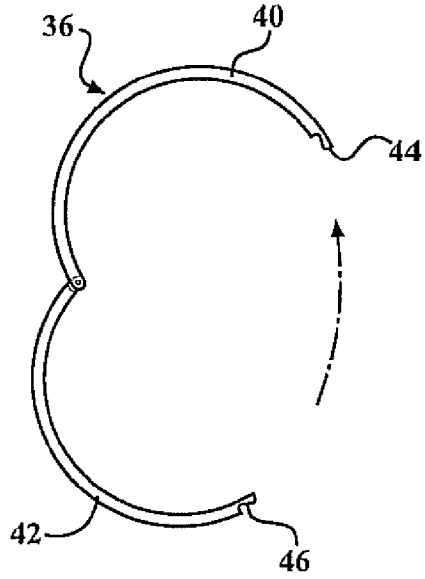
FIG. 4 is a sectional view of a selected binder ring according to one preferred application of the present invention.

As best illustrated in FIG. 4, each of the rings 36 and 38, and which is represented by first ring 36, is separately attachable and disengageable from the display portion by a first pivotally associated and arcuately configured portion 40 and second pivotally associated and arcuately configured portion 42. A clasp 44 extends from an arcuately extending end of each of the first configured portion 40 and is receivingly engaging within an aperture 46 defined proximate an end of the second associated configured portion 42 and upon rotating the first 40 and second 42 configured portions towards each other and in an engaging position.

Figure 2:
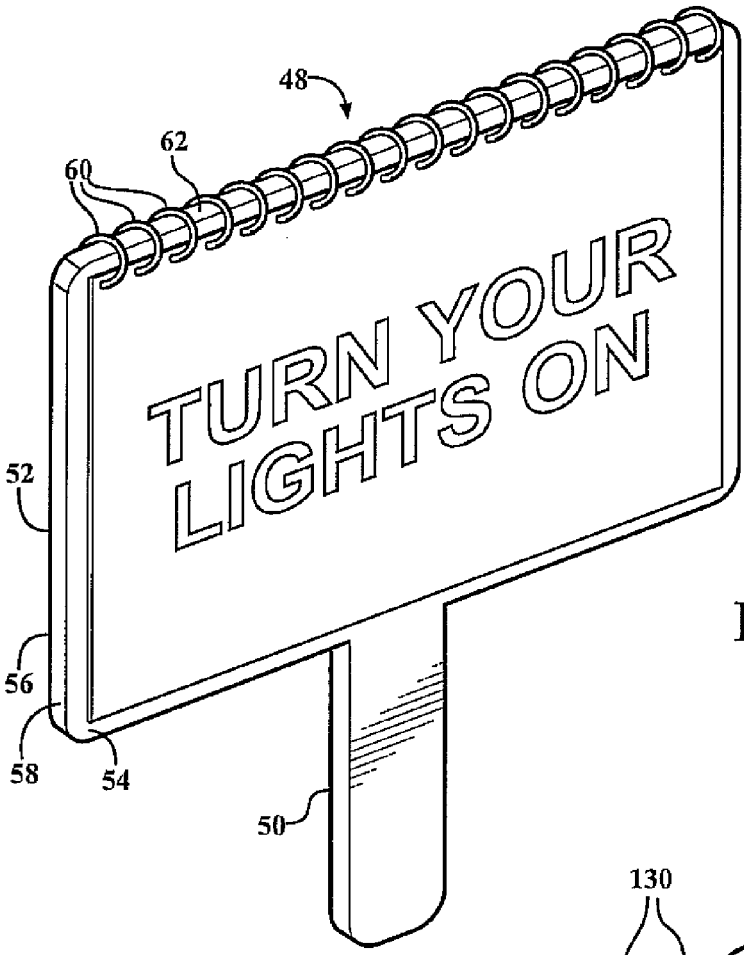
FIG. 2 is perspective view of the hand-held and inter-auto display device according to a second preferred variant of the present invention.

An alternative embodiment of the present invention is illustrated at 48 in FIG. 2. The embodiment 48 again includes a support with a handle portion 50 and an interconnecting and substantially planar display portion 52 with a first surface 54 and a second oppositely facing surface 56 defining therebetween a specified thickness 58. A plurality of spiral binding portions 60 are illustrated engaging through the display portion 52, between the first 54 and second 56 facing surfaces, and proximate an extending edge 62 opposite the handle portion.

Although not illustrated in the embodiment of FIG. 2, it is also envisioned that the spiral bindings can take the form of a continuously curled and elongate extending strip which is bound through an associated plurality of spaced apertures defined proximate the top extending edge 62. It is also envisioned that other types of circular or spiral binding may be employed without deviating from the scope of the invention.

Referring again to FIG. 3, an additional feature of the invention also contemplates a display mount 64 at a specified location within the vehicle, such as upon a top surface of dashboard 66 or other fixed location which is easily and safely accessible by the operator or other occupant in the vehicle 14. The display mount 64 may seatingly engage the handle portion (such as portion 16 of first variant 10) and so that the message arrayed upon the display portion is visible to occupants of other vehicles. This is in addition to the first preferred embodiment in which the placard display 10 or 48 is handheld.

Figure 5:
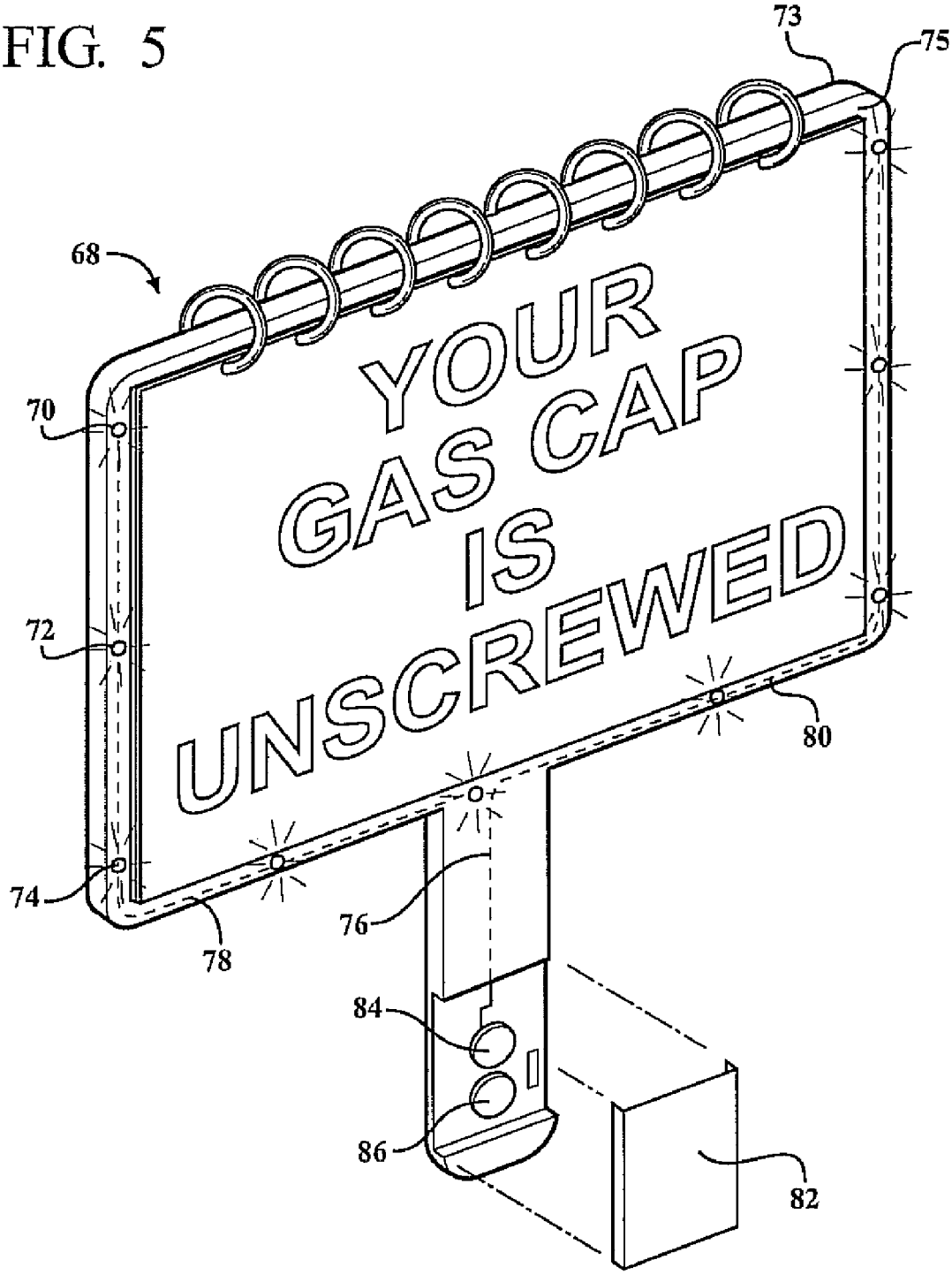
FIG. 5 is a perspective view of a further variant and including the incorporation of additional illuminating or lighting aspects, such as LED elements, to the extending surface perimeter of the supporting display portion, this further including a handle compartment accessible and portable power supply such as a Lithium ion or other type watch battery.

Referring now to FIG. 5, a perspective view is shown at 68 of a further variant of the handheld display which incorporates a type of visual enhancement including the addition of illuminating or lighting aspects, such as LED elements 70, 72, 74, et. seq, and such as which are arranged at extending surface perimeter locations of the supporting display portion. The display portion as shown can be constructed such as in first and second halves (see at 73 and 75) and is press-fit or otherwise vibrationally welded to encapsulate therebetween a network arrangement of communication lines, see in phantom at 76, 78 and 80, extending from a handle located compartment to the LED elements 70, 72, 74, et. seq., this in turn including a releasable cover 82 and which reveals a portable power supply, such as one or more Lithium ion or other type watch battery, see for example at 84 and 86.

Other features illustrated in FIG. 5, such as the construction of the display sheets and the arrangement of the spiral binding can be as substantially shown in the previously disclosed embodiment of FIG. 2. Also, and while LED lighting elements represent one ideal application of a highly illuminating, low power requiring and impact resistant illuminating element, it is further understood and envisioned that other lighting elements can be substituted within the scope of the invention.

Figure 6:
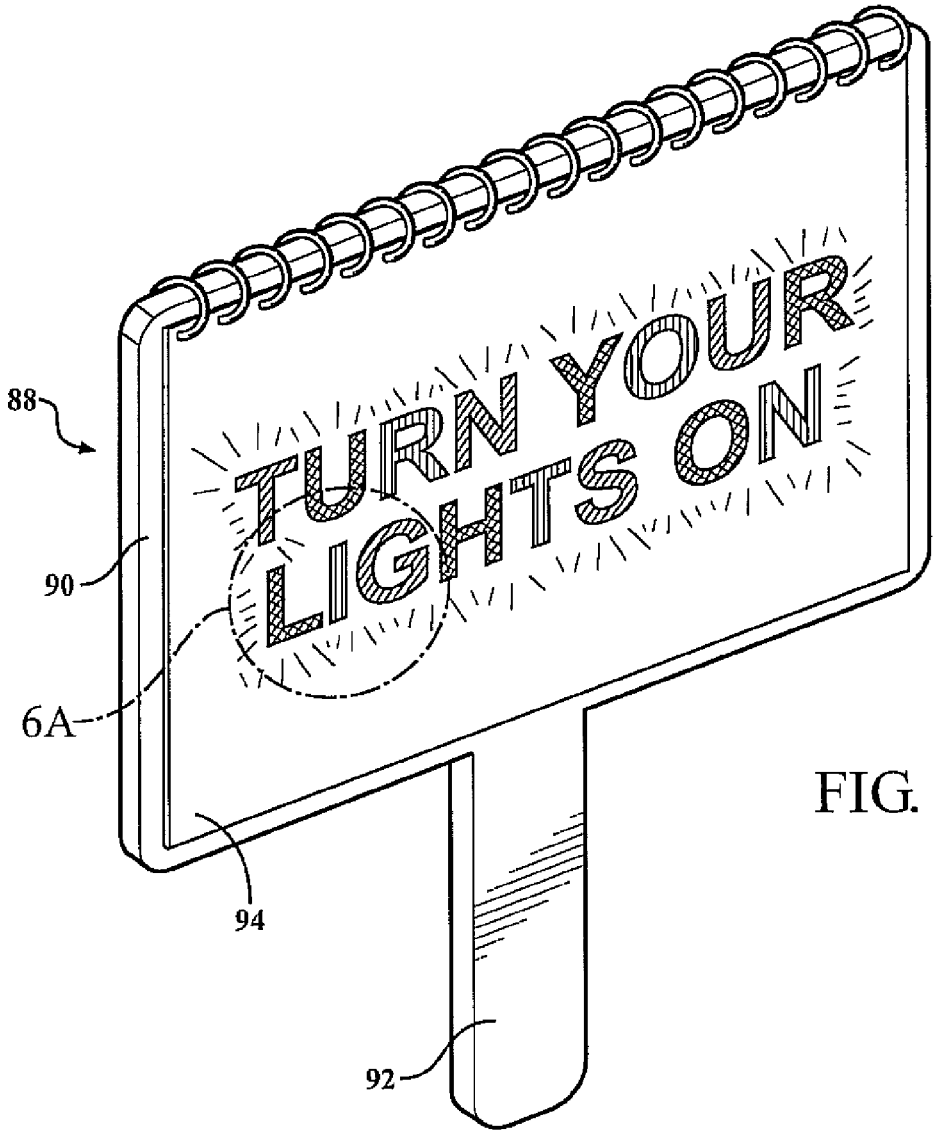
FIG. 6 is an illustration of another variant and which includes forming the display portion and/or handle with a phosphorescent (glowing) composition to assist in easy identification.
Figure 6A:
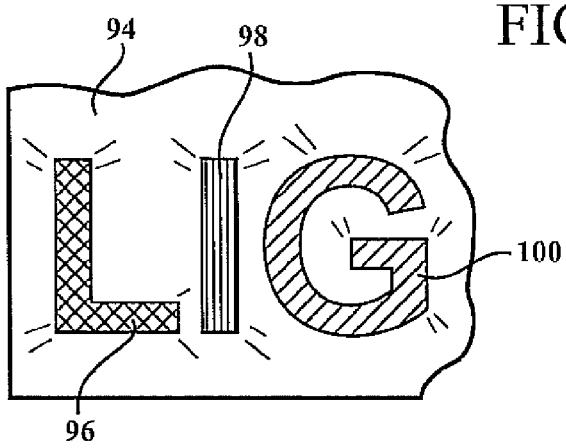
FIG. 6A is an enlarged illustration taken from FIG. 6 and further showing that the individual message sheets can also exhibit luminescent or light reflective lettering, such as to assist in ease of remote identification, the individual lettering of the sheets also exhibiting color (or multi-coloring) to further assist in identification.

Referring now to FIG. 6, an illustration is shown at 88 of another variant of visual enhancement and which includes forming a display portion 90 and/or handle portion 92 with a phosphorescent (glowing) composition to assist in easy identification. As further shown in FIG. 6A, which is an enlarged illustration taken from FIG. 6, the individual message sheets (see for example sheet 94) can also exhibit luminescent or light reflective lettering, reference being had to letters 96, 98 and 100, such as to assist in ease of remote identification. As illustrated, the individual lettering of the sheets also exhibiting color (or multi-coloring as for example shown by orange lettering associated with letter "L" 96 and pink/red lettering associated with letter "i" 98), these further assisting in identification.

FIG. 7B is an illustration 102 of a fold-out message panel configuration according to a further preferred embodiment and which is secured to a surface of a display portion 104. As further shown in FIG. 7A (which is a succeeding illustration of the fold-out panel configuration) a series of overlapping and selected edge connected sheets of individually semi-rigid and durable construction (e.g. of panel-like consistency) are provided and each further exhibits a semi-rigid consistency for unfolding in order to establish an enlarged display area.

Figure 7C:
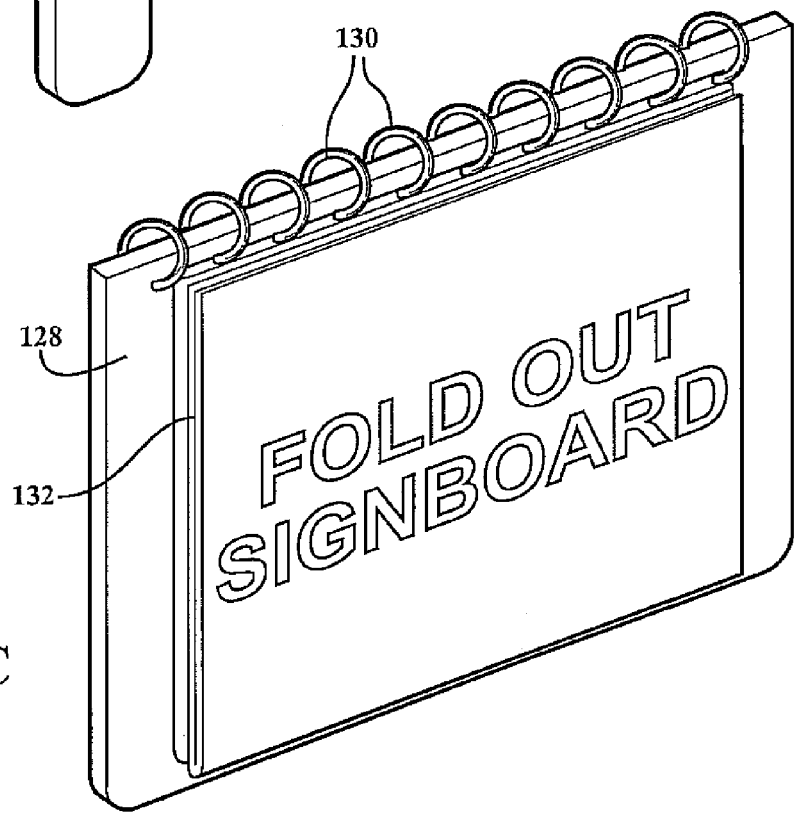
FIG. 7C is on illustration of a further sub-variant of FIG. 7B, and in which a rigid support sheet is spiral bound to the display portion, an inner-most of the fold out/fold down sheets being secured to a surface of the rigid support sheet, the unfolding sheets again each exhibiting semi-rigid consistency and in order to establish the enlarged display area.

Specifically, and as shown in FIG. 7A, a base and central secured panel 106 (such as which is adhered or glued to the surface of the display portion or to a rigid and spiral supported sheet as shown in FIG. 7C) is provided and from which is unfolded first 108 and second 110 side panels, as further referenced by directional arrows 112 and 114, respectively. Each of the central secured panel 106 and side unfolded panels 108 and 110 include a further fold-down panel, see at 116, 118 and 120 respectively, and as further reflected by directional arrows 122, 124 and 126, and which collectively establishes an enlarged display area upon which a message of particular importance can be placed and in order to gain the attention of such as another motorist.

Referring finally to FIG. 7C, an illustration is shown at of a further sub-variant of FIG. 7B, and in which a rigid support sheet 128 is capable of being spiral bound (see spiral binding portins 130) to a display portion (not shown). As with the related variant of FIGS. 7A and 7B, an inner-most of a plurality of fold out/fold down sheets, see as generally shown at 132 and further such as is described in FIG. 7A, is secured to a surface of the rigid support sheet 128.

The unfolding sheets again each exhibiting semi-rigid consistency, such permitting them maintain their shape when establishing an enlarged display area. As with the earlier disclosed variants, the lettering associated with the fold-out sheets can include any form of reflective or other lighted fours of visual enhancement.

Having described my invention, additional preferred embodiments will become apparent to those skilled in the art to which it pertains and without deviating from the scope of the appended claims.

The invention claimed is:

1. A hand-held inter-auto display device, comprising:

a body including a handle portion and an interconnecting and substantially planar display portion;

a plurality of individual sheets pivotally bound to said planar display portion, each displaying at least a portion of a selected message from at least one side thereof of said planar display portion;

a visual enhancement element associated with at least one of said handle, display portion and said sheets, said visual enhancement element further comprising a plurality of LED lighting elements at perimeter spaced locations along said display portion of said body;

further comprising said body being constructed as first and second halves to encapsulate therebetween a network arrangement of communication lines to said LED elements;

a compartment located in said handle portion and including a releasable cover which reveals a portable power supply; and a selected message being displayed upon an exposed sheet supported upon said display portion.

2. The display as described in claim 1, said power supply further comprising at least one Lithium ion battery.

3. The display device as described in claim 1, said visual enhancement element further comprising a phosphorescent composition applied to said body.

4. The display device as described in claim 1, said visual enhancement element further comprising at least one of a luminescent or a light reflective lettering applied to said sheets.

5. The display device as described in claim 4, further comprising multi-coloring of said lettering.

6. The display device according to claim 1, further comprising a display mount at a specified location within a vehicle, within which may be seatingly engaged said handle portion.

7. The display device according to claim 1, said plurality of individual sheets each further comprising a semi-rigid posterboard material.

8. The display device according to claim 1, said sheets being pivotally bound to said planar display portion, said pivotal binding further comprising at least one binding ring engaging through said display portion, between first and second facing surfaces defining therebetween a selected thickness of said body, and proximate an extending edge opposite said handle portion.

9. The display device according to claim 8, further comprising a pair of first and second binding rings located at specified and spaced apart distances, each of said rings being separately attachable and disengageable from said display portion.

10. The display device according to claim 8, each of said binding rings further comprising a first pivotally associated and arcuately configured portion and a second pivotally associated and arcuately configured portion, a clasp extending from an end of said first configured portion and receivingly engaging within an aperture defined proximate an end of said second configured portion.

11. The display device according to claim 8, further comprising a plurality of spiral binding portions engaging through said display portion.

12. The display device according to claim 1, said body further comprising an integrally formed material selected from a group including polymers and plasticized resins.

* * * * *